US007536784B2

(12) United States Patent
Sun et al.

(10) Patent No.: US 7,536,784 B2
(45) Date of Patent: May 26, 2009

(54) SINTERING APPARATUS FOR HEAT PIPE AND METHOD FOR MANUFACTURING THE SAME

(75) Inventors: Sobo Sun, Taoyuan (TW); Tony Wang, Taoyuan (TW)

(73) Assignee: Chaun-Chong Technology Corp., Taipei (TW)

( * ) Notice: Subject to any disclaimer, the term of this patent is extended or adjusted under 35 U.S.C. 154(b) by 592 days.

(21) Appl. No.: 11/056,253

(22) Filed: Feb. 14, 2005

(65) Prior Publication Data

US 2006/0179653 A1 Aug. 17, 2006

(51) Int. Cl.
*B23P 6/00* (2006.01)

(52) U.S. Cl. ..... 29/890.032; 29/890.045; 29/726; 165/104.26

(58) Field of Classification Search ..... 29/726, 29/890.045, 890.032; 165/104.26
See application file for complete search history.

*Primary Examiner*—Rick K Chang

(57) ABSTRACT

A sintering method for a wick structure of a heat pipe includes the steps of inserting a shaft inside the pipe body such that a tapered head is assembled to the shrunk end to achieve a second positioning point, wherein another end of the shaft extending to the filling tool forms a first positioning point corresponding to the clamping section. The filling tool fills a wick structure into a uniform gap defined by the shaft and the pipe body and clamped by the first positioning point and the second positioning point. The wick structure is sintered and cooled to complete a heat pipe having wick structure of uniform thickness.

3 Claims, 4 Drawing Sheets

SINTERING APPARATUS FOR HEAT PIPE AND METHOD FOR MANUFACTURING THE SAME

BACKGROUND OF THE INVENTION

1. Field of the Invention

The present invention relates to a sintering apparatus for heat pipe and method for manufacturing the same, and more particularly to a sintering apparatus for heat pipe having wick structure of uniform thickness and method for manufacturing the same, thus enhancing yield and reducing cost.

2. Description of Prior Art

FIGS. 1 and 2 show the conventional apparatus for manufacturing wick structure in heat pipe by sintering process. A copper pipe 1 with one sealed end is used as main body of heat pipe and a funnel 11 is assembled to an open end of the copper pipe 1. A center rod 12 is inserted into the copper pipe 1 through the open end. A gap 13 is defined between the center rod 12 and an inner wall of the copper pipe 1 and used for sintering the wick structure 10. A copper powder used for manufacturing the wick structure is dropped to the gap 13 through the funnel 11. The copper powder is then combined to the inner wall of the copper pipe 1 through a sintering process. Afterward, the center rod 12 is withdrawn from the copper pipe 1 and a hollow heat pipe with wick structure formed on the inner wall thereof is thus constructed, as shown in FIG. 2

As shown in FIG. 3, in above-mentioned manufacturing process for the heat pipe, the diameter of the center rod 12 is smaller than the inner diameter of the copper pipe 1 and the funnel 11 to define the gap 13. However, there is no structure or measure to fix the center rod 12 within the copper pipe 1 and the center rod 12 may be inclined in the copper pipe 1. The copper powder dumped into the gap 13 cannot be uniformly applied. As shown in FIG. 2, the wick structure 10 formed on the inner wall of the copper pipe 1 also has not uniform thickness. The thermal conveying effectiveness is influenced when the wick structure 10 on the inner wall of the copper pipe 1 is not uniform.

SUMMARY OF THE INVENTION

The present invention provides a sintering apparatus for heat pipe having wick structure of uniform thickness and method for manufacturing the same, thus enhancing yield and reducing cost.

In one aspect of the present invention, the method comprises the steps of inserting a shaft inside the pipe body such that a tapered head is assembled to the shrunk end to achieve a second positioning point, wherein another end of the shaft extending to the filling tool forms a first positioning point corresponding to the clamping section. The filling tool fills a wick structure into a uniform gap defined by the shaft and the pipe body and clamped by the first positioning point and the second positioning point. The wick structure is sintered and cooled to complete a heat pipe having wick structure of uniform thickness.

In another aspect of the present invention, the sintering apparatus for heat pipe, comprises a pipe body with a shrunk end at one end thereof and an open end at another end thereof;

a filling tool with a clamping section and having a sleeve with a funnel to assemble to the open end;

a shaft inserted to the pipe body;

wherein the two ends of the shaft form positioning points with respect to the shrunk end and the filling tool such that a gap with uniform separation is defined between the shaft and an inner wall of the pipe body.

The above summaries are intended to illustrate exemplary embodiments of the invention, which will be best understood in conjunction with the detailed description to follow, and are not intended to limit the scope of the appended claims.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Figure 1:
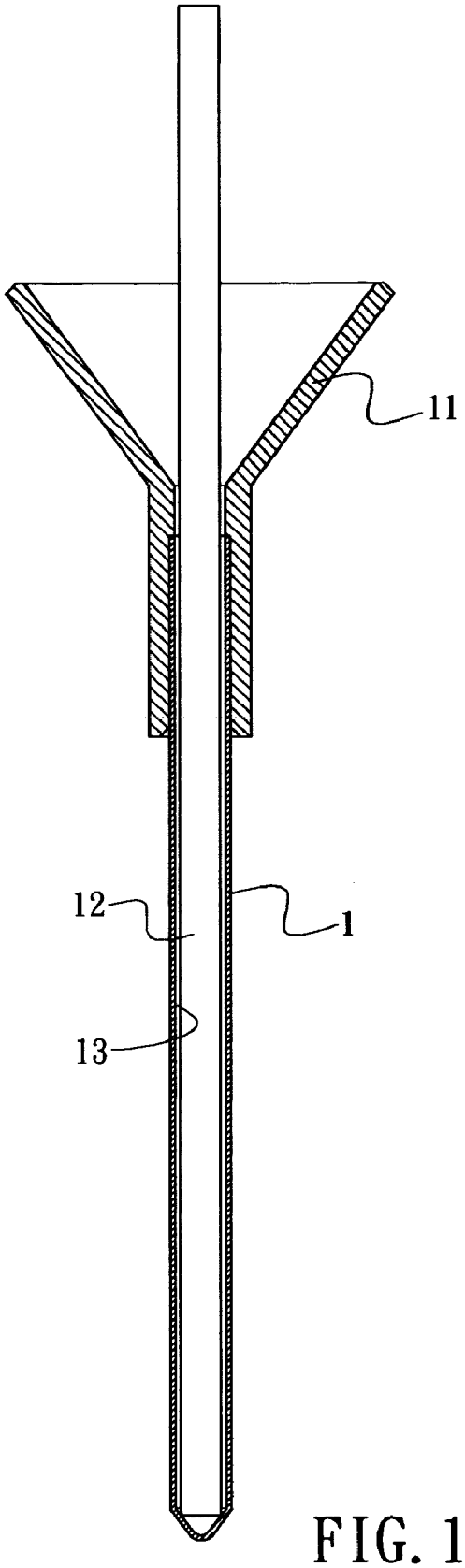
FIG. 1 PRIOR ART
FIG. 1 is a sectional view of a prior art sintering apparatus for heat pipe.
Figure 2:
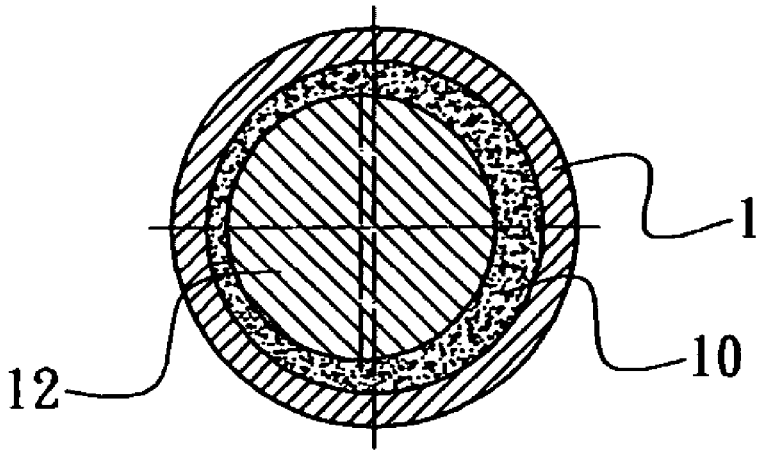
FIG. 2 is another sectional view of a prior art sintering apparatus for heat pipe.
Figure 3:
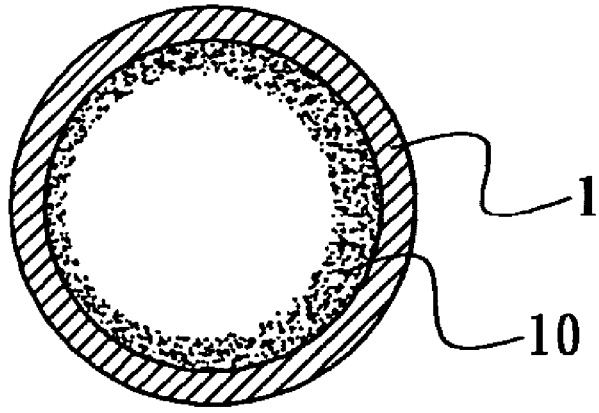
FIG. 3 is still another sectional view of a prior art sintering apparatus for heat pipe.
Figure 4:
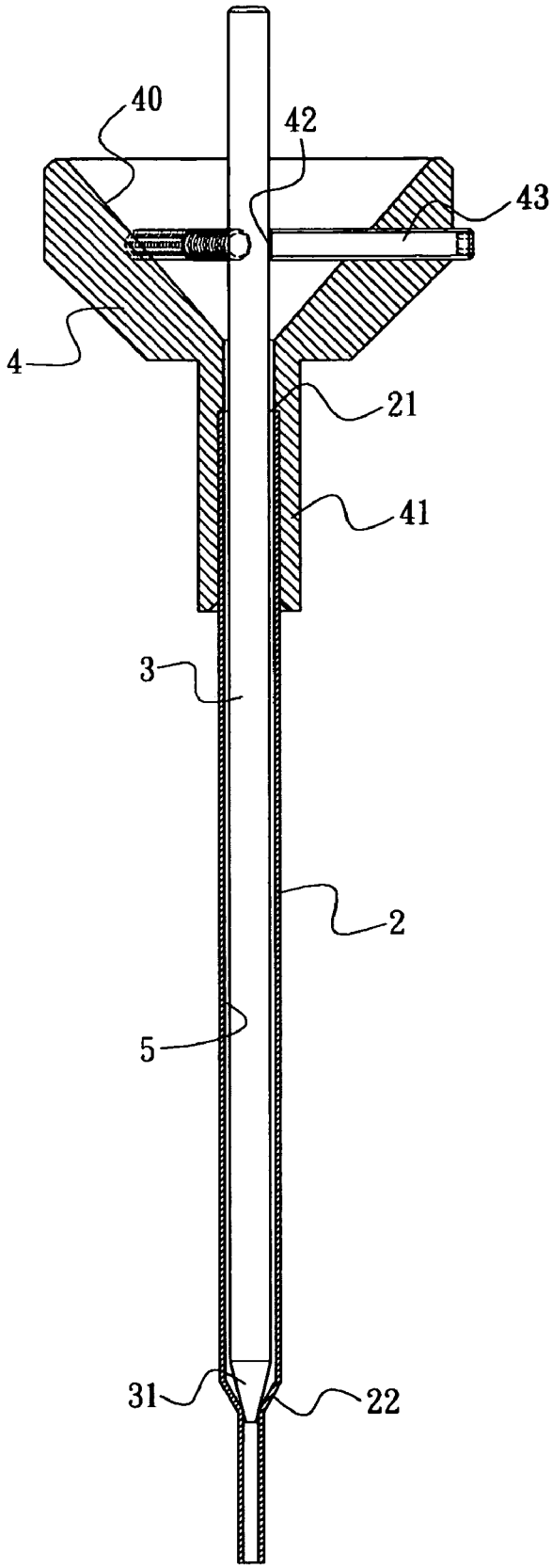
FIG. 4 is a sectional view of the present invention.
Figure 5:
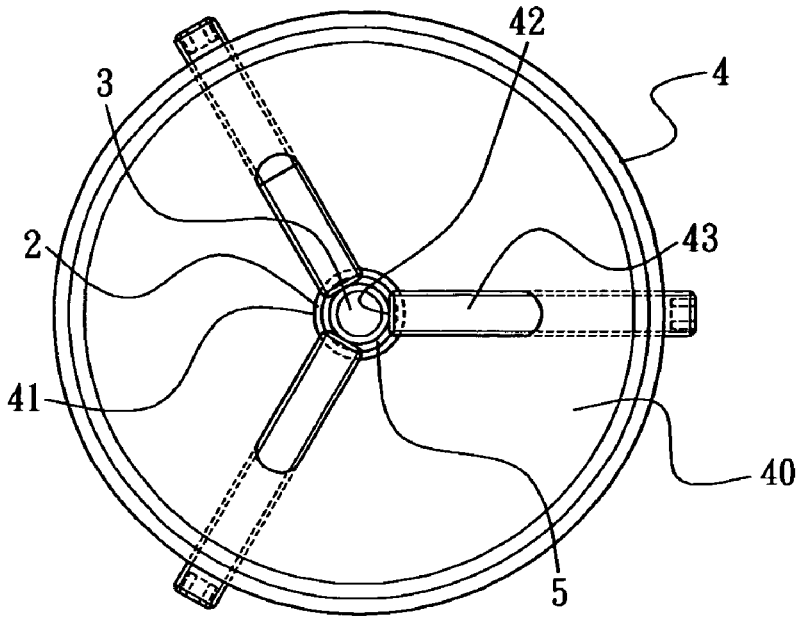
FIG. 5 is a sectional view of the clamping element of the present invention.
Figure 6:
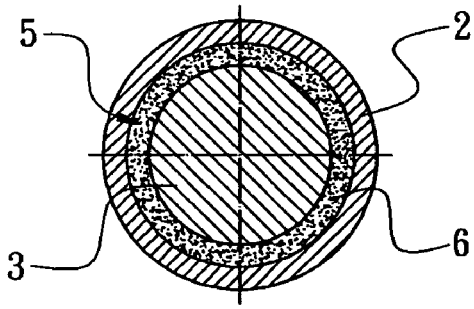
FIG. 6 is a sectional view of the present invention for sintering process.

With reference to FIGS. 4 and 5, the sintering apparatus according to the present invention comprises a pipe body 2 for manufacturing heat pipe, a shaft 3 inserted into the pipe body 2 and a filling tool 4 with a first positioning point.

The pipe body 2 is an elongated hollow pipe with an open end 21 and a shrunk end 22 opposite to the open end and being not sealed. The shrunk end 22 has a diameter smaller than the diameter of the pipe body 2 and functions as a second positioning point for the shaft 3.

The shaft 3 is an elongated rod inserted into the hollow pipe body 2. The diameter of the shaft 3 is smaller than the inner diameter of the pipe body 2. A gap 5 with uniform separation is defined between the outer diameter of the shaft 3 and the inner wall of the pipe body 2 when the shaft 3 is inserted into the pipe body 2 and clamped by the first positioning point and second positioning point. Therefore the wick structure 6 is filled and sintered. The shaft 3 has a tapered head 31 to provide the second positioning point and inserted to the shrunk end 22 when the shaft 3 is inserted into the pipe body 2.

In a preferred embodiment of the present invention, the filling tool 4 is a funnel with a sleeve 41 for sealing the open end 21 of the pipe body 2 such that a wick structure 6 is filled into the pipe body 2 through the funnel. The filling tool 4 further comprises a clamping section 42 in a space defined by the funnel wall 40. The clamping section 42 provides a first positioning point for the shaft 3 corresponding to the filling tool 4. The clamping section 42 is in the filling tool 4 and corresponding to a concentric position of the sleeve 41. The clamping section 42 has an inner diameter corresponding to the outer diameter of the shaft 3. The shrunk end 22 provides a second positioning point and the clamping section 42 provides the first positioning point for the shaft 3.

The clamping section 42 of the filling tool 4 is a rib arm integrally formed with the funnel wall 40 to provide a rigid clamping element. Alternatively, the clamping section 42 of the filling tool 4 comprises a plurality of adjusting elements 43 such as screws to provide adjustable clamping action and position adjustment as shown in FIGS. 4 and 5.

FIGS. 4 to 7 show a procedure according to the method of the present invention. The filling tool 4 is assembled to the open end 21 of the pipe body 2. Afterward, the shaft 3 is inserted to hollow of the pipe body 2 and the tapered head 31 is assembled to the shrunk end 22 to achieve the second positioning point. The shrunk end 22 is sealed to prevent leakage of the wick structure 6 during filling process. The shaft 3 extends to one end of the filling tool 4 and achieves the first positioning point with respect to the clamping section 42 of the filling tool 4. The shaft 3 is clamped in hollow of the pipe body 2 by the first and the second positioning point such that a gap with uniform separation 5 is defined between the shaft 3 and the inner wall of the pipe body 2. Into the gap 5 the wick structure 6 is filled as shown in FIGS. 4 and 5.

Figure 7:
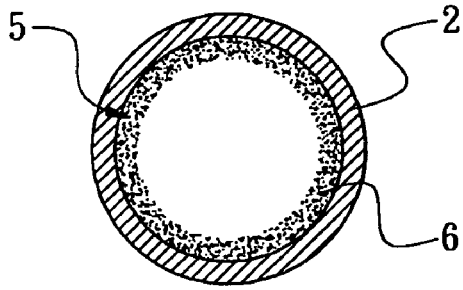
FIG. 7 is a sectional view of the present invention for sintering process.

The wick structure 6 is guided by the funnel of the filling tool 4 and filled into the gap 5 as shown in FIG. 4. Then the wick structure 6 is sintered in a sintering furnace. After cooling, the hot molten wick structure 6 is set on the inner wall of the pipe body 2. Afterward, the shaft 3 is withdrawn from the pipe body 2 to complete the heat pipe having wick structure of uniform thickness as shown in FIG. 7.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A sintering method for a wick structure of a heat pipe, comprising the steps of:

providing a pipe body (2) having an open end (21) and a shrunk end (22);

providing a filling tool (4) with a clamping section (42) and assembling the clamping section (42) to the open end (21);

inserting a shaft (3) inside the pipe body (2) such that a tapered head (31) of the shaft (3) is assembled to the shrunk end (22) to achieve a second positioning point, wherein another end of the shaft (3) extending to the filling tool (4)forms a first positioning point corresponding to the clamping section (42); and filling a wick structure (6) into a gap (5) defined between the shaft (3) and the pipe body (2), sintering the wick structure (6) and cooling the wick structure (6) to complete a heat pipe having wick structure (6) of uniform thickness, wherein the clamping section (42) comprises a plurality of adjusting elements (43) to provide clamping action and position adjustment.

2. The sintering method as in claim 1, wherein the shrunk end (22) is sealed by the tapered head (31) of the shaft (3) such that the filled wick structure (6) is not leaked.

3. The sintering method as in claim 1, wherein the clamping section (42) is a rib arm integrally formed with a funnel wall (40) to provide a rigid clamping element.

* * * * *